US005310522A

United States Patent [19]

Culling

[11] Patent Number: 5,310,522

[45] Date of Patent: May 10, 1994

[54] HEAT AND CORROSION RESISTANT IRON-NICKEL-CHROMIUM ALLOY

[75] Inventor: John H. Culling, St. Louis, Mo.

[73] Assignee: Carondelet Foundry Company, Pevely, Mo.

[21] Appl. No.: 987,372

[22] Filed: Dec. 7, 1992

[51] Int. Cl.[5] ..... C22C 30/00; C22C 38/44

[52] U.S. Cl. ..... 420/585; 420/586; 420/586.1; 148/442

[58] Field of Search ..... 420/585, 586, 586.1; 148/442

[56] References Cited

U.S. PATENT DOCUMENTS 2,703,277 3/1955 Spendelow, Jr. et al. ..... 75/171
4,400,210 8/1983 Kudo et al. ..... 420/585

FOREIGN PATENT DOCUMENTS 57-134536 8/1982 Japan ..... 420/586.1

*Primary Examiner*—R. Dean
*Assistant Examiner*—Sikyin Ip
*Attorney, Agent, or Firm*—Senniger, Powers, Leavitt & Roedel

[57] ABSTRACT

Alloys are provided which consist essentially by weight percentages of from about 30% to about 35% Ni, from about 22% to about 25% Cr, from about 4% to about 6.5% Mo, from about 0.2% to about 1.5% W, from about 0.2% to about 0.6% Nb, from about 0.1% to about 0.6% Ti, from about 0.35% to about 1.75% Co, from about 0.05% to about 0.3% C, from about 0.2% to about 1.3% Si, from about 0.2% to about 1.5% Mn, and the balance essentially iron and the usual impurities.

6 Claims, No Drawings

HEAT AND CORROSION RESISTANT IRON-NICKEL-CHROMIUM ALLOY

FIELD OF THE INVENTION

This invention relates to heat and corrosion resistant iron-base alloys suitable for use in turbine and furnace parts and petrochemical environments where such articles must possess resistance to oxidation, carburization, thermal fatigue and corrosion by chemical substances. The alloys are fully austenitic and can be air melted, wrought, cast and readily welded.

BACKGROUND OF THE INVENTION

Spendelow, et al, U.S. Pat. No. 2,703,277 discloses a nickel-base superalloy of relatively low strategic metal content for high temperature service as well as for resistance to attack by various corrosive media. This alloy has been widely employed under the tradename Hastelloy X or by the designation HX or, simply, X.

Hundreds of newer heat and/or corrosion resistant alloys have been developed in the almost four decades since the introduction of the X alloy, yet it continues to be employed in a wide variety of applications. It is said to have an excellent balance of resistance to chemical substances, oxidizing, reducing and neutral atmospheres at temperatures up to 2200° F. combined with good weldability and fabricability. It is used in turbine and furnace parts and petrochemical equipment and is a standard material for gas turbine combustors. Alloy X has good resistance to carburization and nitriding and to stress-corrosion cracking, in part, due to its high molybdenum content. In industrial furnaces the alloy is especially suitable for fans, roller hearths and support members.

Most of the innovations in the field of heat resistant alloys have related to increasing high temperature hot strength with the consequent penalty of much lowered ductility, elongation, weldability and fabricability. However, there is an inverse relationship of generally diminishing corrosion resistance with increasing hot strength in the heat resistant alloy field. Also, the higher hot strength alloys not only have low ductilities as produced but also often suffer much further loss of ductility in service at elevated temperature; thus welding before or after periods of service may vary from difficult to virtually impossible. Furthermore, austenitic alloys based upon iron, nickel and chromium of less than about 7% tensile elongation values are very difficult to weld, while those above 15% elongations will have very good weldability.

Thus, there has remained an increasing demand for alloys of the X type. However, because of the increased demand and consumption of nickel and cobalt in industrial and military applications, there has been a tremendously increased interest in development of alloys of the X type but of much lower nickel contents and without the need for large amounts of cobalt.

While nickel base alloys of little or no iron content and large amounts of molybdenum and/or niobium (columbium) have equalled the corrosion resistance of alloy X, and while leaner alloys have equalled the fabricability of alloy X, there has remained a long term demand for alloys that equal Hastelloy X properties at about 35% nickel content and twice the iron content of alloy X, which is about 18%. A series of alloys designated commercially as 800, 800H, 800T and 802 have attempted to provide some of the alloy X properties at a nickel content lower than the nominal 50% Ni content of alloy X. These alloys all nominally contain about 32.5% Ni, 21% Cr, 0.4% Ti, 0.4% Al and up to 0.36% C.

SUMMARY OF THE INVENTION

It is therefore an object of this invention to provide highly ductile, machinable, weldable, castable alloys of high hot strength combined with excellent resistance to oxidizing, reducing and neutral atmospheres and a wide spectrum of chemical substances, but of relatively low nickel content for long term service in turbine and furnace parts. An additional object is to provide alloys having excellent resistance to thermal shock and fatigue, and to carburization and to attack by sulfur, sulfur oxides and chlorine containing substances at service temperatures as high as 2000° to 2200° F.

It is a further object to provide alloys of relatively low strategic element content, as well as relatively low nickel content, which retain fully austenitic matrices at all temperatures and which may be readily formulated from ferroalloys, scraps and returns in ordinary air without significant element process losses.

According to this invention alloys are provided which consist essentially by weight percentages of from about 30% to about 35% Ni, from about 22% to about 25% Cr, from about 4% to about 6.5% Mo, from about 0.2% to about 1.5% W, from about 0.2% to about 0.6% Nb, from about 0.1% to about 0.6% Ti, from about 0.35% to about 1.75% Co, from about 0.05% to about 0.3% C, from about 0.2% to about 1.3% Si, from about 0.2% to about 1.5% Mn, and the balance essentially iron and the usual impurities.

DETAILED DESCRIPTION OF THE INVENTION

The present invention is directed to austenitic, high hot strength, heat and corrosion resistant alloys of excellent resistance to thermal shock and fatigue combined with high ductility and weldability and relatively low nickel content. They may be readily formulated by air melting and pouring practices from ordinary ferroalloys and recycled materials including molybdic oxide as a low cost source for molybdenum.

The alloys of the invention are those having elements in ranges of proportions as follows:

| | |
|---|---|
| NICKEL | 30–35% BY WEIGHT |
| CHROMIUM | 22–25% |
| MOLYBDENUM | 4–6.5% |
| TUNGSTEN | 0.2–1.5% |
| NIOBIUM | 0.2–0.6% |
| TITANIUM | 0.1–0.6% |
| COBALT | 0.35–1.7% |
| CARBON | 0.05–0.30% |
| MANGANESE | 0.2–1.5% |
| SILICON | 0.2–1.3% |
| IRON | ESSENTIALLY BALANCE |

Optionally the alloys of the invention may further contain:

| | |
|---|---|
| ALUMINUM | UP TO 0.15% BY WEIGHT |
| NITROGEN | UP TO 0.10% |
| BORON | UP TO 0.005% |
| ZIRCONIUM | UP TO 0.05% |
| one or more of YTTRIUM, LANTHANUM OR RARE EARTH METALS | UP TO 0.03% total |

-continued

| | |
|---|---|
| COPPER | UP TO 0.7% |

Preferable alloys of the invention are those having elements in the following ranges of proportions:

| | |
|---|---|
| NICKEL | 31-33% BY WEIGHT |
| CHROMIUM | 22-24% |
| MOLYBDENUM | 5-6% |
| TUNGSTEN | 0.5-1.5% |
| NIOBIUM | 0.2-0.6% |
| TITANIUM | 0.15-0.6% |
| COBALT | 0.35-1.7% |
| CARBON | 0.05-0.30% |
| MANGANESE | 0.5-1% |
| SILICON | 0.3-1% |
| ALUMINUM | UP TO 0.1% |
| NITROGEN | UP TO 0.1% |
| BORON | UP TO 0.005% |
| ZIRCONIUM | UP TO 0.025% |
| YTTRIUM, LANTHANUM OR RARE EARTH METALS | UP TO 0.03% |
| COPPER | UP TO 0.7% |
| IRON | ESSENTIALLY BALANCE |

Oxides of molybdenum, tungsten and nickel are unstable at the melting temperatures of the alloys of the invention, at least about 2200°-3500° F. (1200°-1900° C.) so that it has been found possible to employ oxides of those elements as sources for these three elements. However, when such oxides are added to the melt at high temperature, oxygen gas evolves and bubbles through the molten metal. Accordingly, aluminum may be advantageously employed as a deoxidizing element along with the more common deoxidizers silicon and manganese. Up to about 0.15% residual aluminum has not been found to be detrimental to alloys of the invention. Carbon additions may also have to be made to the melt after deoxidation steps are completed, since carbon is apt to be removed as carbon dioxide or carbon monoxide during the period when oxygen is evolving.

It has been found that alloys of the invention that have been induction melted in air may have absorbed nitrogen from the air during the melting process. While the nitrogen could be removed from the metal by various processes it has been found not to be detrimental when present in amounts up to about 0.1%. Boron and zirconium have been advantageously employed to improve the life of many heat resistant alloys and may be present in alloys of the invention up to about 0.005% and 0.05% respectively. Yttrium, lanthanum or various rare earth metals have also been advantageously employed in numerous heat resistant alloys and may be present in alloys of the present invention in amounts up to about 0.03% total content of such elements. Copper is frequently found as a tramp or incidental element present in various heat and corrosion resistant metals and may be present in alloys of the invention in amounts up to about 0.7%.

The following examples further illustrate the invention.

EXAMPLE 1

One hundred pound heats of several different alloys were prepared in accordance with the invention along with a heat of alloy X and one of alloy 800. Each of the heats was air-melted in a 100 pound high frequency induction furnace. Three well-risered double leg tensile test keel blocks and one well-risered corrosion test bar were cast from each heat. The composition of each of these alloys is set forth in Table I. The balance in each case is essentially iron.

TABLE 1

| | COMPOSITION BY WEIGHT PERCENT | | | | | | | | | |
|---|---|---|---|---|---|---|---|---|---|---|
| | Ni | Cr | Mo | W | Nb | Ti | Co | C | Mn | Si |
| Alloys of the invention | | | | | | | | | | |
| H-967 | 31.98 | 23.40 | 4.96 | 1.36 | .28 | .16 | .92 | .28 | .78 | .96 |
| H-1000 | 32.04 | 23.48 | 5.02 | .86 | .38 | .19 | .74 | .19 | .52 | .48 |
| H-1004 | 32.66 | 22.86 | 4.52 | .56 | .47 | .28 | 1.26 | .11 | .74 | .36 |
| H-1015 | 30.86 | 24.03 | 5.23 | .46 | .23 | .21 | .62 | .23 | .83 | .63 |
| H-1016 | 32.33 | 22.06 | 5.13 | .78 | .41 | .21 | .57 | .09 | .62 | .68 |
| Alloys of the prior art | | | | | | | | | | |
| Hastelloy X | 48.45 | 21.52 | 9.06 | .66 | — | — | 1.51 | .09 | .36 | .23 |
| 800 | 30.51 | 20.52 | — | — | — | .36 | — | .07 | .57 | .45 |

Room temperature mechanical properties, as determined for each of these alloys, are set forth in Table II. A test bar from alloy H-1004 and one from alloy H-1016 were solution annealed at 2150° F. for three hours and oil quenched. The room temperature mechanical properties for these two test bars are also set forth in Table II.

TABLE II

| | ROOM TEMPERATURE MECHANICAL PROPERTIES | | | |
|---|---|---|---|---|
| ALLOY | TENSILE STRENGTH PSI | YIELD STRENGTH PSI | % ELON-GATION | BRINELL HARD-NESS |
| H-967 | 60,700 | 35,600 | 18.5 | 179 |
| H-1000 | 77,600 | 37,400 | 24.5 | 168 |
| H-1004 | 71,600 | 41,300 | 28 | 148 |
| H-1015 | 62,700 | 38,800 | 18 | 180 |
| H-1016 | 76,800 | 47,300 | 31 | 155 |
| Hastelloy X | 93,900 | 47,000 | 41 | 180 |
| 800 | 77,200 | 28,800 | 45 | 128 |
| SOLUTION ANNEALED | | | | |
| H-1004 | 82,100 | 42,200 | 36 | 175 |
| H-1016 | 72,400 | 37,200 | 38 | 155 |

From these results it is obvious that despite their iron contents being approximately double those for alloy X, the alloys of the invention have very similar room temperature mechanical properties with elongations in the range required for excellent weldability.

EXAMPLE 2

Standard one quarter inch diameter test bars were machined from each of the available bars for alloys of the invention. These bars were then subjected to stress-to-failure testing at elevated temperatures in air on standard creep frames of the cantilever load type. The results of these tests are set forth in Table III. The values for alloys X and 800 were taken from the abundant literature available for those alloys.

TABLE III

| HOURS TO FAILURE AT VARIOUS STRESSES AND TEMPERATURES | | | | |
|---|---|---|---|---|
| | STRESS, PSI | | | |
| | 1600° F. | | | |
| ALLOY | 8000 | 7000 | 6000 | 5000 |
| H-967 | 282.8 | 731.3 | 2445.4 | — |
| H-1000 | — | — | 1027.8 | 2614.4 |
| H-1015 | — | 584.8 | — | 3197.8 |
| Hastelloy X | 215 | 450 | 1000 | 2500 |
| 800 | 10 | 25 | 50 | 150 |
| | 1700° F. | | | |

TABLE III-continued

| HOURS TO FAILURE AT VARIOUS STRESSES AND TEMPERATURES STRESS, PSI | | | | |
|---|---|---|---|---|
| | 5000 | 4000 | 3000 | |
| H-967 | 666.9 | 2966.5 | — | |
| H-1000 | — | 741.9 | 4543.6 | |
| H-1015 | 351.8 | 1264.3 | — | |
| Hastelloy X | 200 | 600 | 2300 | |
| 800 | 15 | 60 | 330 | |
| | 1800° F. | | | |
| | 3000 | 2500 | 2000 | 1500 |
| H-1000 | 451.7 | — | — | — |
| H-1004 | — | — | — | 3802.7 |
| H-1015 | — | 1698.5 | — | — |
| Hastelloy X | — | — | 1255.7 | — |
| 800 | 200 | 475 | 1200 | 3700 |
| | 2000° F. | | | |
| | 1500 | 1000 | 800 | |
| H-1004 | 53.9 | 238.8 | 539.2 | |
| H-1016 | 48.6 | 204.3 | 466.7 | |
| Hastelloy X | 45 | 200 | 450 | |
| 800 | 20 | 90 | 200 | |

From these results it is evident that the minimum rupture lives for alloys of the invention, in all cases approximately equalled or exceeded the average values for alloy X, while alloy 800 values were drastically lower in all instances.

EXAMPLE 3

The corrosion test bars for the alloys of the invention along with those for alloys X and 800 were machined into ½ inch diameter by ¼ inch thick discs, each having ⅛ inch diameter hole in the center. These discs were polished to a 600-grit finish and cleaned in solvent followed by water and detergent to remove all dust Particles, cutting oil or foreign matter. Each cleaned disc was weighed to the nearest 1,000th of gram and then suspended by platinum wire in various solutions at room temperature. The corrosion rate for each disc, in mils per year, was calculated in accordance with the formula:

$$Rmpy = 393.7 \frac{Wo - Wf}{ATD}$$

where

Rmpy=corrosion rate in mils per year

Wo=original weight of sample in grams

Wf=final weight of sample in grams

A=areas of sample in square cm

T=duration of test in years

D=density of alloy in gm/cc

The final weight was obtained by cleaning the test samples in water with a nylon brush after exposure periods of 48 hours and reweighing.

The results of these tests are set forth in Table IV.

TABLE IV

| ATTACK IN SULFURIC ACID-WATER SOLUTIONS AT ROOM TEMP., MILS PER YEAR | | | | | | |
|---|---|---|---|---|---|---|
| | ACID STRENGTH | | | | | |
| ALLOY | 1.25% | 2.5% | 5% | 10% | 20% | 40% |
| H-967 | .9 | 1.4 | 1.4 | 8.0 | 9.7 | 10.9 |
| H-1000 | .7 | 1.2 | 1.3 | 7.6 | 8.8 | 10.3 |
| H-1004 | .5 | 1.1 | 1.2 | 6.8 | 7.6 | 9.8 |
| H-1015 | .8 | 1.3 | 1.3 | 7.8 | 9.2 | 10.5 |
| H-1016 | .4 | .8 | .9 | 6.8 | 8.9 | 9.6 |
| Hastelloy X | .4 | .7 | 1.4 | 6.4 | 7.7 | 8.9 |
| 800 | 14.2 | 22.4 | 28.8 | 54.6 | 97.8 | 68.90 |

TABLE IV-continued

| ATTACK IN NITRIC ACID-WATER SOLUTIONS AT ROOM TEMP., MILS PER YEAR | | | |
|---|---|---|---|
| | ACID STRENGTH | | |
| | 10% | 35% | 60% |
| H-967 | 16.7 | 12.7 | 21.3 |
| H-1000 | 11.3 | 10.7 | 18.7 |
| H-1004 | 6.7 | 6.8 | 17.6 |
| H-1015 | 14.5 | 11.5 | 20.8 |
| H-1016 | 5.8 | 5.3 | 10.8 |
| Hastelloy X | 5.6 | 5.2 | 10.6 |
| 800 | 5.3 | 5.4 | 9.6 |

The test results in Table IV show that the alloys of the invention have corrosion resistance properties generally equal to those of alloy X, and significantly better than those of alloy 800. Further, I have learned that alloys which resist attack of nitric acid as well as a wide range of dilutions of sulfuric acid and water will possess excellent resistance to a very broad spectrum of corrosive chemical substances.

U.S. Pat. No. 2,703,277 discloses tests measuring the corrosion resistance of alloy X in three different concentrations of boiling nitric acid. Since boiling nitric acid solutions are employed to reveal the propensity of alloys for intergranular attach due to carbide precipitation at metal grain boundaries, only alloys H-1004 and H-1016 were subjected to such tests. The three other alloys of the invention, which contained higher carbides, would be expected to demonstrate this form of attack. Alloy X will also suffer intergranular attack unless solution annealed at 2100° to 2200° F.

Since none of the corrosion test specimens were solution annealed at high temperature, the test data for alloy X was taken from the '277 patent. Those data along with the test results of alloys H-1004 and H-1016 are set forth in Table V.

TABLE V

| ATTACK IN BOILING NITRIC ACID SOLUTIONS | | | |
|---|---|---|---|
| ALLOY | 5% | 25% | 10% |
| H-1004 | 5.5 | 10.1 | 14.1 |
| H-1016 | 5.3 | 10.2 | 13.8 |
| Hastelloy X | 5.6 | 10.7 | 13.6 |

These tests results reveal substantially the same corrosion resistance for the two alloys of the invention as for alloy X despite the fact that the former were not solution heat treated at high temperature. This is no doubt due in great part to the fact that alloys H-1004 and H-1016 contained sufficient amounts of niobium and titanium to essentially completely stabilize their carbon contents. Even though these two elements were included in the alloys of the invention because of their beneficial effects upon hot strength, they also obviously improve corrosion resistance in some instances.

From the above heat strength and corrosion tests it may be seen that alloys of the invention have properties that at least equal those of alloy X despite the fact that the former contain only about two thirds of the nickel content and twice the iron content of the latter.

In view of the above, it will be seen that the several objects of the invention are achieved.

Although specific examples of the present invention are Provided herein, it is not intended that they are exhaustive or limiting of the invention. These illustrations and explanations are intended to acquaint others skilled in the art with the invention, its principles, and its practical application, so that they may adapt and apply the invention in its numerous forms, as may be best suited to the requirements of a particular use.

What is claimed is:

1. An nickel-chromium-iron alloy having good heat resistan properties consisting essentially of:

| | |
|---|---|
| NICKEL | 30-35% BY WEIGHT |
| CHROMIUM | 22-25% |
| MOLYBDENUM | 4-6.5% |
| TUNGSTEN | 0.2-1.5% |
| NIOBIUM | 0.2-0.6% |
| TITANIUM | 0.1-0.6% |
| COBALT | 0.35-1.7% |
| CARBON | 0.19-0.30% |
| MANGANESE | 0.2-1.5% |
| SILICON | 0.2-1.3% |
| IRON | ESSENTIALLY BALANCE |

2. An alloy of claim 1 further containing:

| | |
|---|---|
| ALUMINUM | UP TO 0.15% BY WEIGHT |
| NITROGEN | UP TO 0.10% |
| BORON | UP TO 0.005% |
| ZIRCONIUM | UP TO 0.05% |
| one or more of YTTRIUM, LANTHANUM OR RARE EARTH METALS | UP TO 0.03% total |
| COPPER | UP TO 0.7% |

3. An alloy of claim 1 consisting essentially

| | |
|---|---|
| NICKEL | 31-33% BY WEIGHT |
| CHROMIUM | 22-24% |
| MOLYBDENUM | 5-6% |
| TUNGSTEN | 0.5-1.5% |
| NIOBIUM | 0.2-0.6% |
| TITANIUM | 0.15-0.6% |
| COBALT | 0.35-1.7% |
| CARBON | 0.19-0.25% |
| MANGANESE | 0.5-1% |
| SILICON | 0.3-1% |
| ALUMINUM | UP TO 0.1% |
| NITROGEN | UP TO 0.1% |

-continued

| | |
|---|---|
| BORON | UP TO 0.005% |
| ZIRCONIUM | UP TO 0.025% |
| one or more of YTTRIUM, LANTHANUM OR RARE EARTH METALS | UP TO 0.03% total |
| COPPER | UP TO 0.7% |
| IRON | ESSENTIALLY BALANCE |

4. An alloy of claim 2 consisting essentially

| | |
|---|---|
| NICKEL | 31.98% BY WEIGHT |
| CHROMIUM | 23.40% |
| MOLYBDENUM | 4.96% |
| TUNGSTEN | 1.36% |
| NIOBIUM | .28% |
| TITANIUM | .16% |
| COBALT | .92% |
| CARBON | .28% |
| MANGANESE | .78% |
| SILICON | .96% |

5. An alloy of claim 2 consisting essentially

| | |
|---|---|
| NICKEL | 32.04% BY WEIGHT |
| CHROMIUM | 23.48% |
| MOLYBDENUM | 5.02% |
| TUNGSTEN | .86% |
| NIOBIUM | .38% |
| TITANIUM | .19% |
| COBALT | .74% |
| CARBON | .19% |
| MANGANESE | .52% |
| SILICON | .48% |

6. An alloy of claim 2 consisting essentially

| | |
|---|---|
| NICKEL | 30.86% BY WEIGHT |
| CHROMIUM | 24.03% |
| MOLYBDENUM | 5.23% |
| TUNGSTEN | .46% |
| NIOBIUM | .23% |
| TITANIUM | .21% |
| COBALT | .62% |
| CARBON | .23% |
| MANGANESE | .83% |
| SILICON | .63% |

* * * * *